US008181658B2

(12) United States Patent
Hsu

(10) Patent No.: US 8,181,658 B2
(45) Date of Patent: May 22, 2012

(54) PLASTIC HAIR CLIP

(76) Inventor: Shih-Ling Hsu, Tainan (TW)

( * ) Notice: Subject to any disclaimer, the term of this patent is extended or adjusted under 35 U.S.C. 154(b) by 365 days.

(21) Appl. No.: 12/457,862

(22) Filed: Jun. 24, 2009

(65) Prior Publication Data

US 2010/0326460 A1 Dec. 30, 2010

(51) Int. Cl.

| | |
|---|---|
| ***A45D 8/20*** | (2006.01) |
| ***C08G 79/02*** | (2006.01) |
| *C08F 212/08* | (2006.01) |
| *C08F 283/00* | (2006.01) |
| *C08L 85/02* | (2006.01) |

(52) U.S. Cl. ..... 132/277; 525/328.8; 525/333.3; 525/538; 528/398; 528/400; 528/425

(58) Field of Classification Search ..... 528/400, 528/398, 425; 132/277; 525/328.8, 333.3, 525/538

See application file for complete search history.

(56) References Cited

U.S. PATENT DOCUMENTS 6,562,938 B2 * 5/2003 Haile et al. ..... 528/271

* cited by examiner

*Primary Examiner* — Duc Truong
(74) *Attorney, Agent, or Firm* — Bacon & Thomas, PLLC

(57) ABSTRACT

The present invention provides a plastic hairclip features in enabling to open and close by plastic resilience intrinsically. The plastic hairclip comprises a mount retainer, a lever retainer with a pair of releasing tabs, a hinged pivotal root and a pair of open-able jaws, which functions to accommodate, hold and release a hair bundle by intrinsic plastic resilience thereof. The plastic hairclip is made of a polymerized plastic mixture by 55% of 1,4-cyclohexanedimethanol (CHDM), 30% of ethylene glycol (EG), 10% of phosphotungstic acid (PTA), 1% of optical brightener and 4% of polypropylene (PP) or butadiene-styrene copolymers sold under the trademark, K-Resin with 5% tolerance for each individual component respectively. Thereby, the plastic hairclip product features in good malleability, re-plasticization ability and tenacity as well as good artistic effect in shining brightness and eco-friendly effect.

9 Claims, 9 Drawing Sheets

PLASTIC HAIR CLIP

TECHNICAL FIELD OF THE INVENTION

The present invention relates to a plastic hairclip, particularly for one that features in enabling to open and close by plastic resilience intrinsically. The plastic hairclip is made of a polymerized plastic mixture by 55% of 1,4-cyclohexanedimethanol (CHDM), 30% of ethylene glycol (EG), 10% of phosphotungstic acid (PTA), 1% of optical brightener and 4% of polypropylene (PP) or butadiene-styrene copolymers sold under the trademark, K-Resin.

BACKGROUND OF THE INVENTION

Generally speaking, different conventional hairdressing devices such as hairpin, hairclip, hair-hoop, hair-ring and hair neatening tool are used by women to do their hairdressing jobs or to shape their hairdos. Normally, the hairclip is required to have bend-resistant feature, metal spring of suitable rigidness and resilience are favorably adopted by the hairclip industries. Moreover, various plastic ornamental pieces are pasted on the metal hairclip to enhance the color pattern, grain and quality sense for artistic requirement. The conventional metal hairclip with plastic ornamental pieces has following intrinsic drawbacks. For metal used in the hairclip, other than manufacturing cost being tremendously affected by the global price fluctuation, it is susceptible to corrosion especially in moisturized ambient. For plastic ornamental pieces used in the hairclip, other than complicated pasting process in fabrication, it produces toxic constituents during combustion. For recycling the wasted metal hairclip with plastic ornamental pieces, sorting and separating process become more difficult and hazardous as dissolution and combustion methods are inevitably involved.

For avoiding the foregoing drawbacks prevailed in the conventional metal hairclip with plastic ornamental pieces, some stark plastic hairclips, which is made of single plastics such as acrylonitrile-butadiene-styrene copolymer (ABS resin), polycarbonate (PC) or polymethylmethacrylate (acrylic), are attempted to market by some vendors. However, such stark plastic hairclips are susceptible to rupture, breakage, whiten-crazing effect at bent portion and aging effect because of lacking for malleability, re-plasticization ability and tenacity.

SUMMARY OF THE INVENTION

The present invention relates to a plastic hairclip, particularly for one that features in enabling to open and close by plastic resilience intrinsically. Having realized and addressed on the existing drawbacks in the conventional hairclips, the primary object for the applicant of the present invention is to contrives a better material than metal and pure plastics so that the hairclip product not only has features in malleability and tenacity to avoid rupture, breakage and whiten-crazing effect at bent portion but also has feature in re-plasticization ability to prevent the present invention from aging effect of the plastic ornamental pieces, the corrosion effect of the metal frame as well as sorting and recycling issues in the conventional hairclips. In order to achieve foregoing objects, the technological means of the present invention contrives a plastic hairclip, which is made of a polymerized plastic mixture comprising 55% of 1,4-cyclohexanedimethanol (CHUM), 30% of ethylene glycol (EG), 10% of phosphotungstic acid (PTA), 1% of optical brightener and 4% of polypropylene (PP) or butadiene-styrene copolymers sold under the trademark, K-Resin with 5% tolerance for each individual component respectively. All the components and each proportional percentage for individual component of the polymerized plastic mixture are obtained from the rule of thumb via practical fabrication and experiment.

DETAILED DESCRIPTION OF THE PREFERRED EMBODIMENTS

By means of detailed description in association with referred drawings in following exemplary embodiments, the features and the technological means for the plastic hairclip of the present invention are manifested for your better understanding and perusal.

Figure 1:
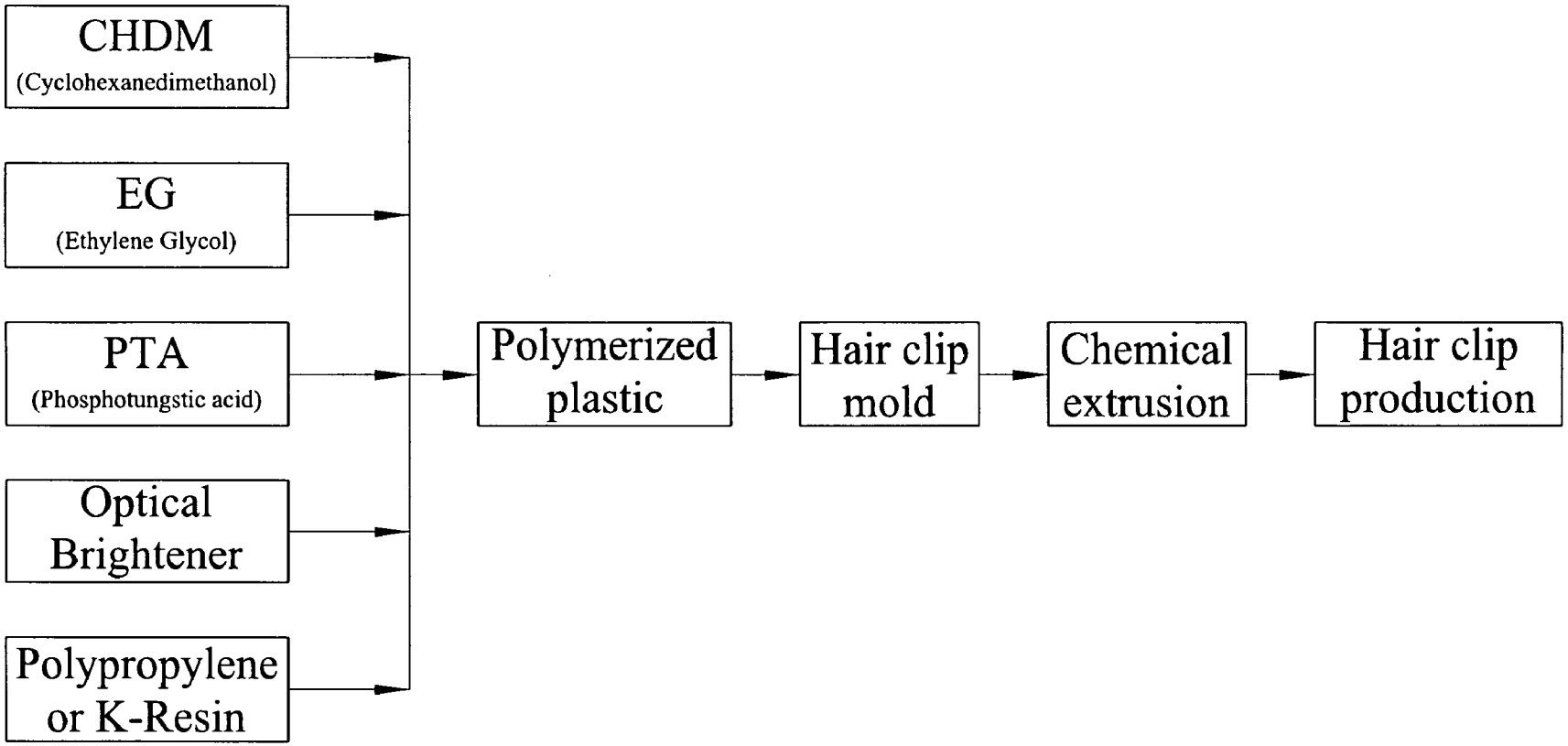
FIG. 1 is a flow chart showing the fabricating process for the plastic hair clip of the present invention.

Please refer to FIG. 1, which shows a flow chart showing the fabricating process for the plastic hair clip of the present invention. After experimental test for the materials used by the plastic hair clip for many times, a polymerized plastic mixture includes 55% of 1,4-cyclohexanedimethanol (CHDM), 30% of ethylene glycol (EG), 10% of phosphotungstic acid (PTA), 1% of optical brightener and 4% of polypropylene (PP) or butadiene-styrene copolymers sold under the trademark, K-Resin with 5% tolerance for each individual component respectively is preferably adopted as optimal material for fabricating the plastic hair clip of the present invention by extrusion method via a preset mold, wherein:

Said 1,4-cyclohexanedimethanol (CHDM), which is primarily used in producing chemically modified polyethylene terephthalate (PET), amorphous material glycol-modified poly-cyclohexylenedimethylene terephthalate (PCTG) of PET modified with CHDM (PETG), engineering plastic substance, adhesive substance and the like, is made from dimethyl terephthalate (DMT) via hydrogenation; Said ethylene glycol (EG) is a thick paste-like liquid with preferable boiling point of 197.37° C.; Said phosphotungstic acid (PTA) is converted from p-Xylene (PX) in the acetic acid solution via catalytic oxidization and thermal refinement under suitable pressure; Said optical brightener is used for enhancing the shining brightness; Said butadiene-styrene copolymers sold under the trademark, K-Resin is a transparent butadiene-styrene copolymer; and said polypropylene (PP) features in flexibly excellent processing ability.

By pouring the polymerized plastic mixture of 1,4-cyclohexanedimethanol (CHDM), ethylene glycol (EG), phosphotungstic acid (PTA), optical brightener and polypropylene (PP) or butadiene-styrene copolymers sold under the trademark, K-Resin into the preset mold of the hairclip to be extruded out, a plastic hairclip of the present invention, which features in good malleability, re-plasticization ability and tenacity without susceptibility to rupture, breakage, whiten-crazing effect at bent portion and aging effect, is fabricated to have artistic effect in shining brightness and eco-friendly effect.

Basically, the plastic hairclip of the present invention comprises a cover jaw-like prong of lever retainer, which functions as a locking arm, and a base jaw-like prong of mount retainer, which functions as a supporting arm, so that a pair of open-able jaws and a jointed root are configured thereby, wherein said pair open-able jaws, which serve for accommodating a hair bundle, are designed to have snap-on locking structure; and said jointed root is either contrived to have pivotal shaft for hinging the lever retainer and mount retainer together or contrived to have jointed root for being unitarily molded with the lever retainer and (mount retainer) into an integral entity.

Figure 2:
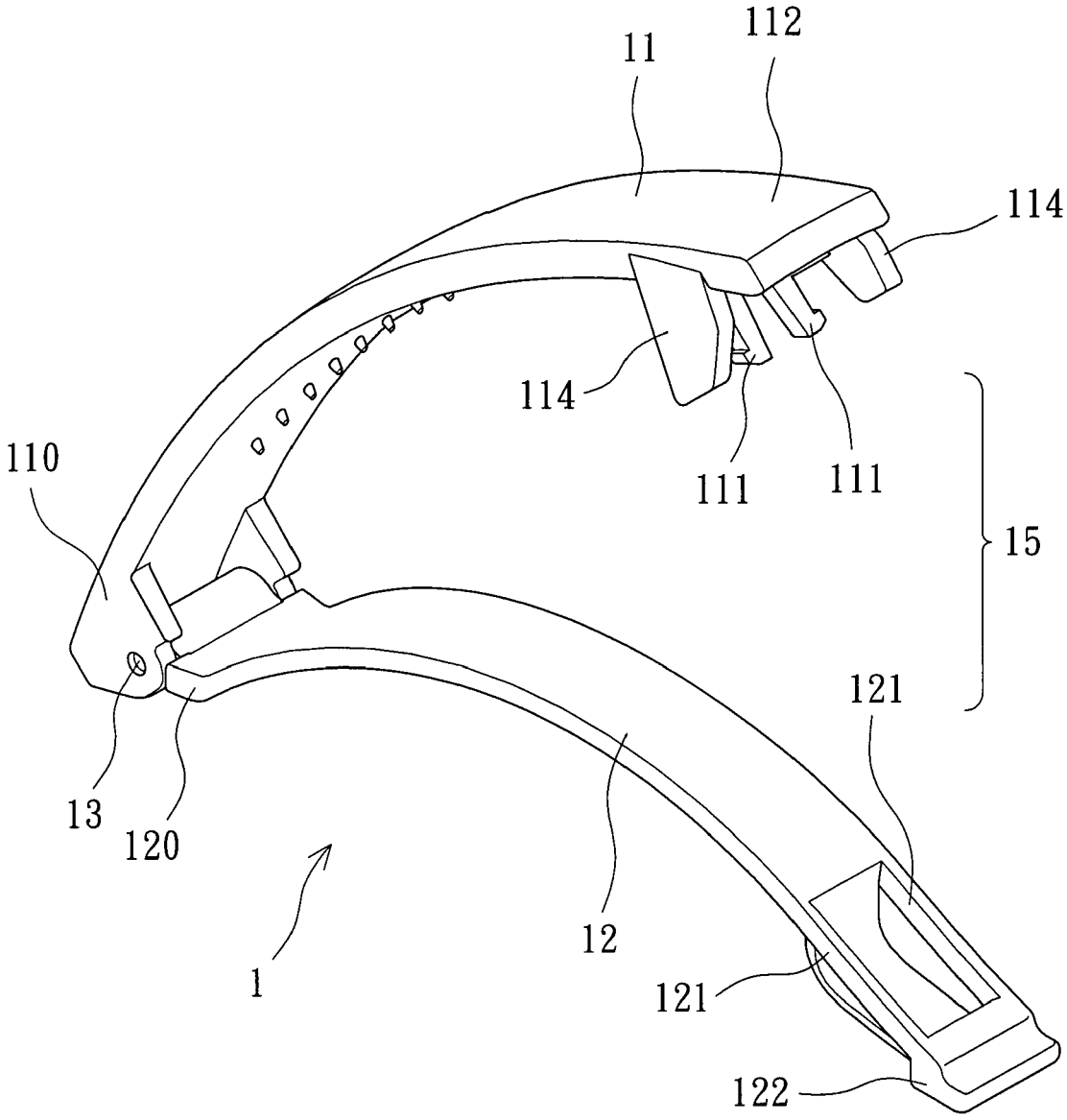
FIG. 2 is a perspective schematic view showing the first exemplary embodiment for the plastic hair clip of the present invention.
Figure 3:
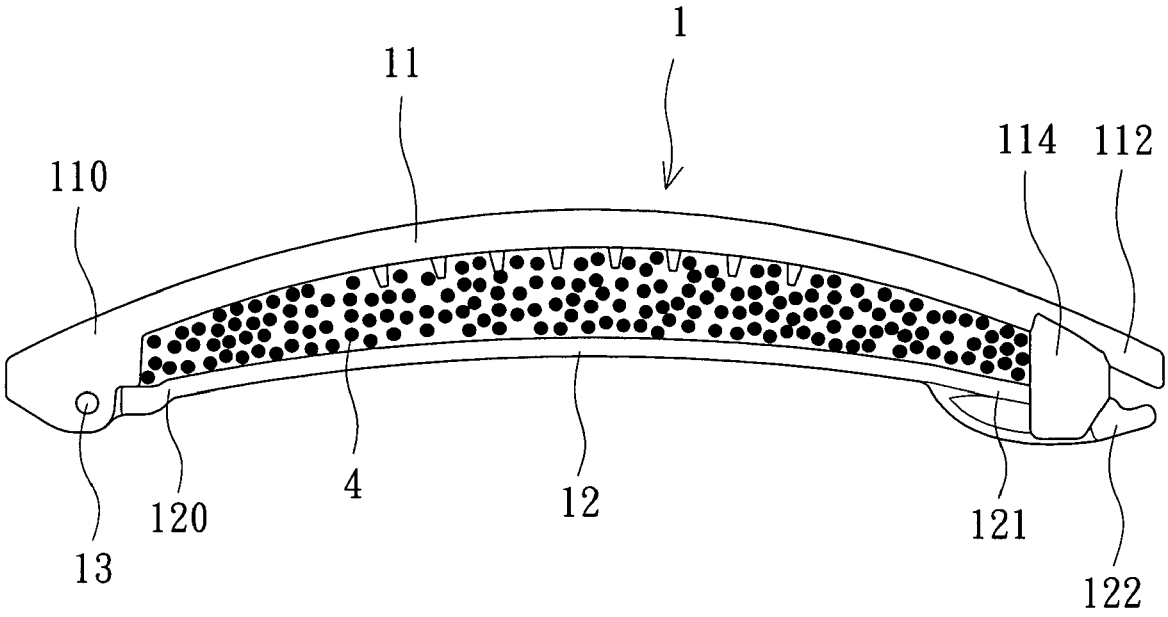
FIG. 3 is a planar schematic view showing the first exemplary embodiment for the plastic hair clip of the present invention holding hair bundle therein.
Figure 4:
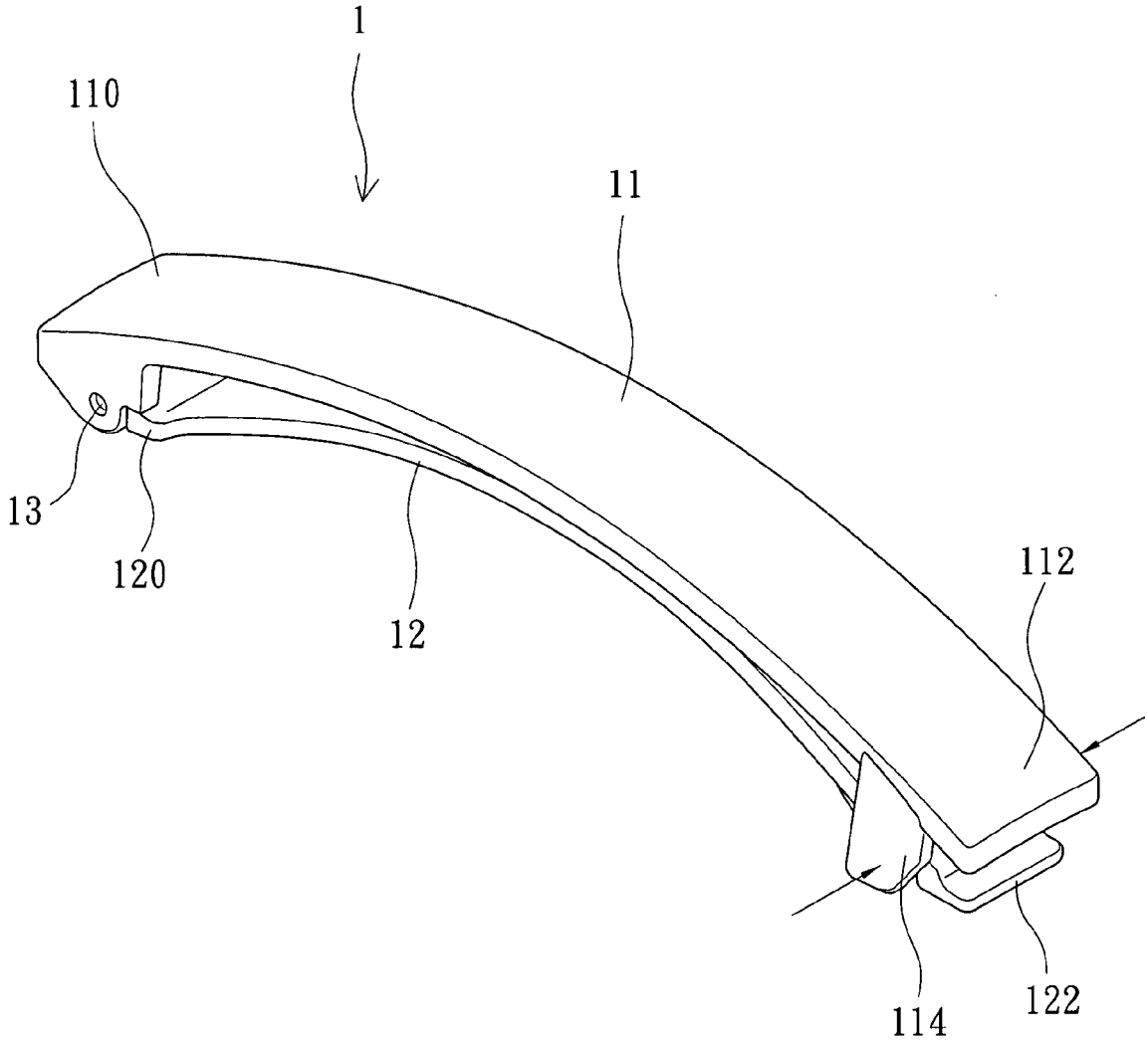
FIG. 4 is a perspective schematic view showing the first exemplary embodiment for plastic hair clip of the present invention in a closed status to be opened by pressing the releasing tab.

Please refer to FIG. 2, which shows the first exemplary embodiment for the plastic hair clip 1 of the present invention. The plastic hair clip 1, which is made of aforesaid polymerized plastic mixture by 1,4-cyclohexanedimethanol (CHDM), ethylene glycol (EG), phosphotungstic acid (PTA), optical brightener and polypropylene (PP) or butadiene-styrene copolymers sold under the trademark, K-Resin, comprises a mount retainer 12 and a lever retainer 11 with a pair of releasing tabs 114 such that a first proximal end 110 of the lever retainer 11 and a first proximal end 120 of the mount retainer 12 are hinged together by a pivotal shaft to form a hinged pivotal root 13 while a second distal end 112 of the lever retainer 11 is configured into a clipping actuator 111 and a second distal end 122 of the mount retainer 12 is configured into a clipping holder 121, which is mutually buckled with the clipping actuator 111; Thereby, in wholly, the hinged first proximal end 110 of the lever retainer 11 and first proximal end 120 of the mount retainer 12 form the hinged pivotal root 13 while the second distal end 112 of the lever retainer 11 and second distal end 122 of the mount retainer 12 form a pair of open-able jaws 15;

In practical hairdressing usage, a hair bundle 4 of group hairs is firstly put between the lever retainer 11 and mount retainer 12 via the open-able jaws 15; Then, the hair bundle 4 is securely held therein by mutually buckling the clipping actuator 111 configured by the second distal end 112 of the lever retainer 11 and the clipping holder 121 configured by the second distal end 122 of the mount retainer 12 to finish the hairdressing job for the hair bundle 4 (as shown in FIG. 3);

Thereby, a bent deformation, which happens on both of the lever retainer 11 and mount retainer 12 due to tensional stress in accommodating the hair bundle 4 therein, is offset by the proper percentage of aforesaid polymerized plastic mixture so that no rupture, breakage, whiten-crazing effect at bent portion will happen because features in malleability, re-plasticization ability and tenacity of the aforesaid polymerized plastic mixture. Especially, no rupture, breakage, whiten-crazing effect at bent portion will happen either at force-exerting or force-bearing portions such as the clipping actuator 111, clipping holder 121 and releasing tabs 114, which is pressed to open the buckled plastic hair clip 1 (as part pointed by the arrowhead shown in FIG. 4).

Figure 5:
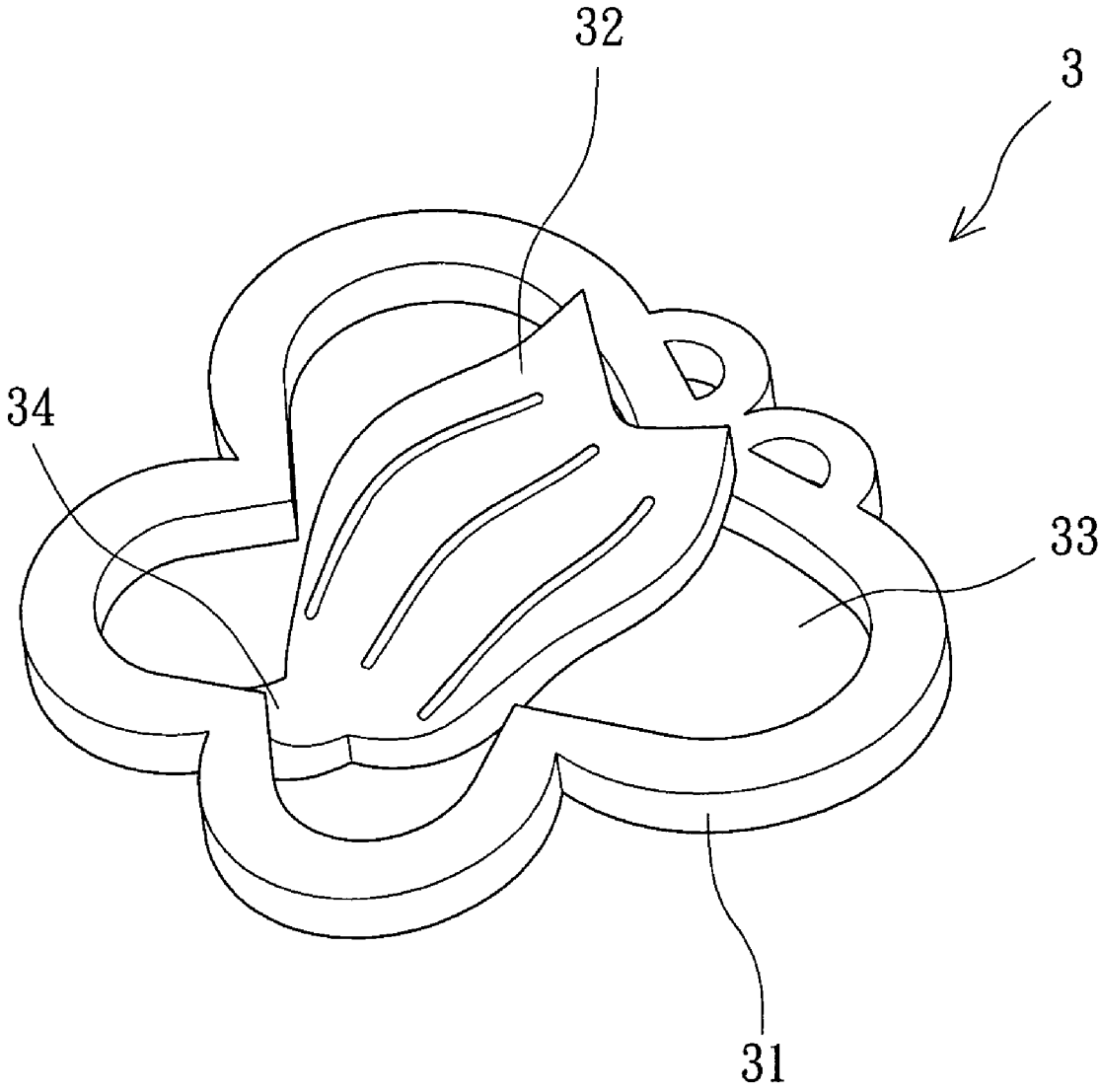
FIG. 5 is a perspective schematic view showing the second exemplary embodiment for another plastic hair clip of the present invention that the plastic hair clip is unitarily extruded into an integral entity having an open-able jaw and a jointed root.
Figure 6:
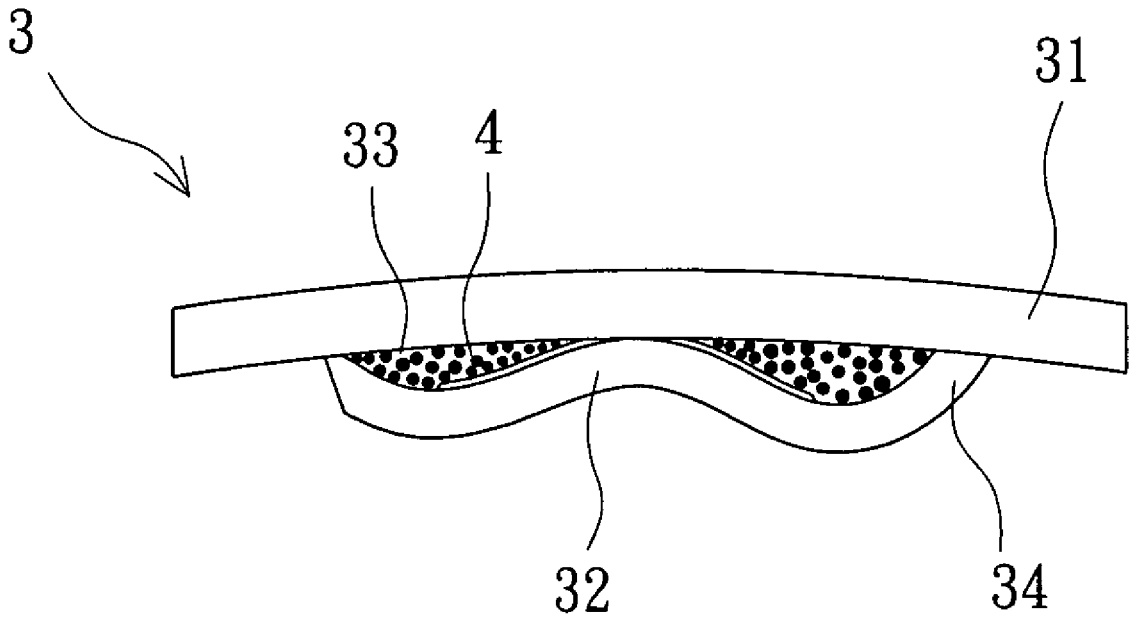
FIG. 6 is a planar schematic view showing the plastic hair clip of the previous FIG. 5 holding hair bundle therein.

Please refer to FIGS. 5 and 6, which show the second exemplary embodiment for another plastic hair clip 3 of the present invention. The plastic hair clip 3, which is unitarily extruded into an integral entity, comprises a mount retainer 31, a lever retainer 32, an open-able jaw 33 and a jointed root 34, which is functionally similar to the hinged pivotal root 13 in the first exemplary embodiment aforesaid. In practical hairdressing usage, a hair bundle 4 is firstly put between the mount retainer 31 and lever retainer 32 via the open-able jaw 33; Then, the hair bundle 4 is securely held therein by mutually buckling the lever retainer 32 and the mount retainer 31 to finish the hairdressing job for the hair bundle 4 (as shown in FIG. 6); Thereby, the entire plastic hair clip 3 including the mount retainer 31, lever retainer 32 and jointed root 34, especially the jointed root 34, will suffer a tensional stress. However, no rupture, breakage, whiten-crazing effect at bent portion will happen in the present invention because features in malleability, re-plasticization ability and tenacity of the aforesaid polymerized plastic mixture.

Figure 7:
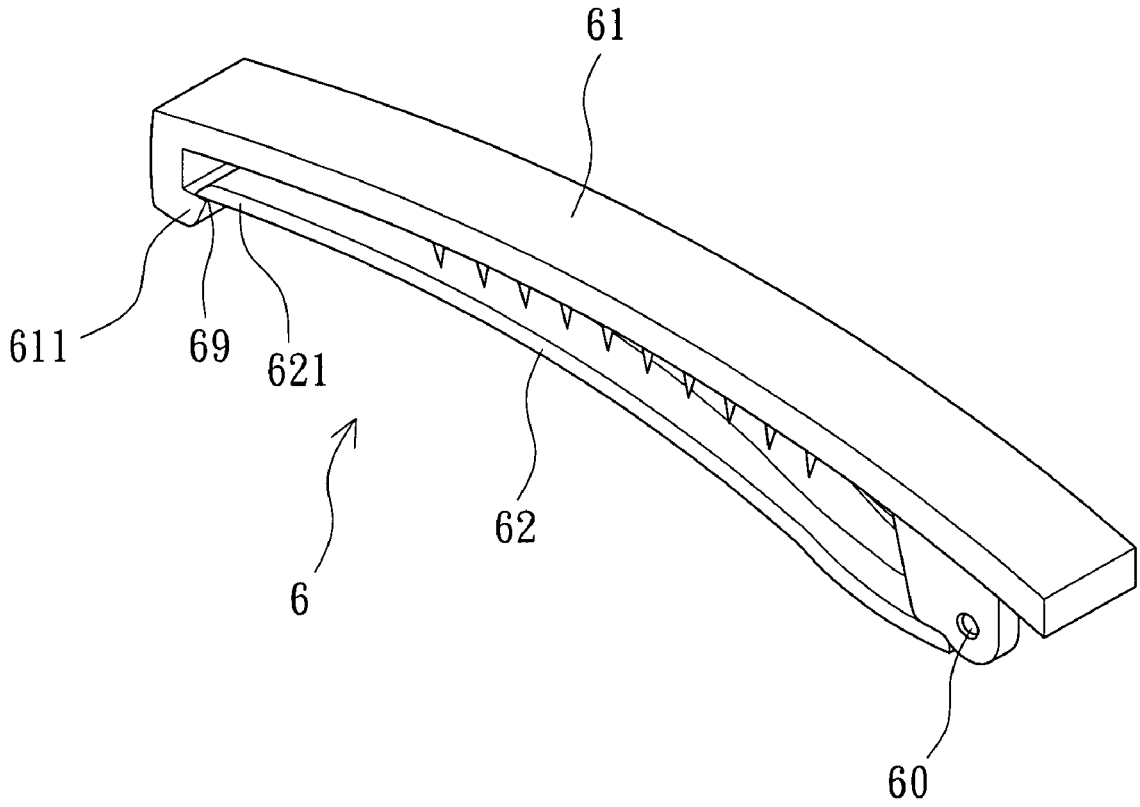
FIG. 7 is a perspective schematic view showing the third exemplary embodiment for another plastic hair clip of the present invention that the plastic hair clip comprises a hinged pivotal root and an open-able jaw, which includes a clipping actuator and a clipping holder.

The plastic hair clip of the present invention always has an open-able jaw and a hinged pivotal root or jointed root though various pattern contrivances are presented. Please refer to FIGS. 7 and 8, which show the third exemplary embodiment for another plastic hair clip 6 of the present invention. The plastic hair clip 6 comprises a mount retainer 62, a lever retainer 61, a hinged pivotal root 60 and a pair of open-able jaws 69, which includes a clipping holder 611 and a clipping actuator 621. In practical hairdressing usage, a hair bundle 4 is put between the lever retainer 61 and mount retainer 62 via the open-able jaws 69; Then, the hair bundle 4 is securely held therein by mutually buckling the clipping actuator 611 and the clipping holder 621 to finish the hairdressing job for the hair bundle 4; Thereby, both middle portions of the mount retainer 62 and lever retainer 61 in the plastic hair clip 6 will outwardly bend due to suffering a tensional stress if too much hairs are held therein. However, no rupture, breakage, whiten-crazing effect at bent portion will happen in the present invention because features in malleability, re-plasticization ability and tenacity of the aforesaid polymerized plastic mixture.

Figure 8:
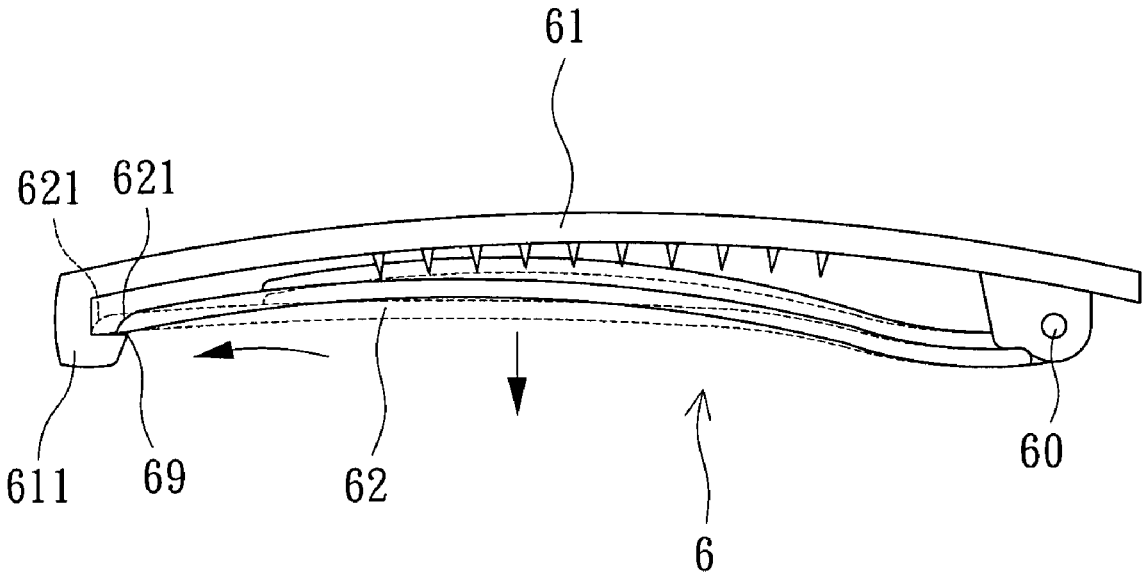
FIG. 8 is a planar schematic view showing a bent deformation for the plastic hair clip of the previous FIG. 7 after having been used for certain time.

For releasing the buckling status of the plastic hair clip 6, hold both bottom ends of the lever retainer 61 and press downwardly on the central top surface of the lever retainer 61 so that the buckling status of the plastic hair clip 6 can be easily released to open (as shown in FIG. 8). For conventional hairclip, the rupture, breakage and whiten-crazing effects at bent portions on the central top surface of the lever retainer 61 and the central section of the mount retainer 62 will be incurred due to strain accumulation of chronically bending stresses thereon, which are frequently undertaken from such buckling and releasing action between the lever retainer 61 and mount retainer 62. However, no rupture, breakage, whiten-crazing effect at bent portion will happen in the present invention because features in malleability, re-plasticization ability and tenacity of the aforesaid polymerized plastic mixture. Thus, the practical usage for the plastic hair clip 6 of the present invention is better than that of the conventional hairclip.

Figure 9:
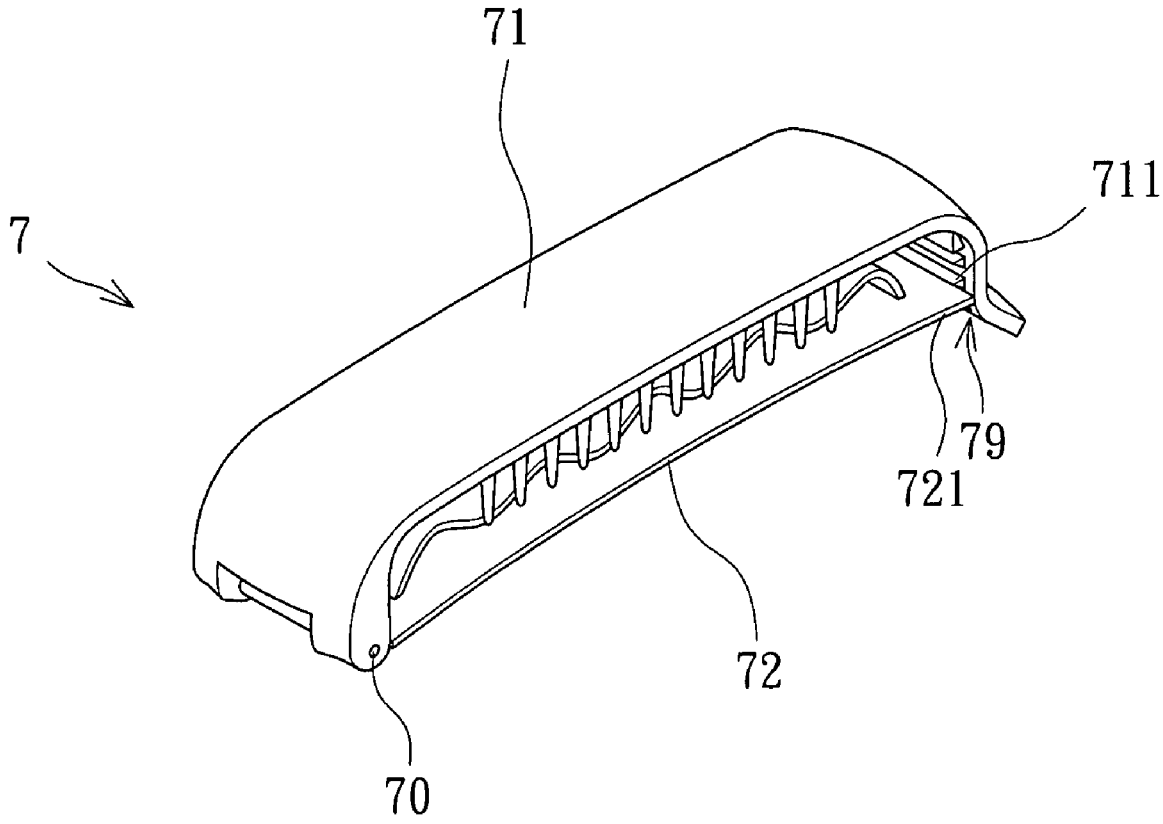
FIG. 9 is a perspective schematic view showing the fourth exemplary embodiment for the other plastic hair clip of the present invention that the plastic hair clip comprises a hinged pivotal root and an open-able jaw, which includes a clipping actuator and a clipping holder.

Similarly, please refer to FIG. 9, which shows the fourth exemplary embodiment for the other plastic hair clip 7 of the present invention. The plastic hair clip 7 comprises a mount retainer 72, a lever retainer 71, a hinged pivotal root 70 and a pair of open-able jaws 79, which includes a clipping holder 711 and a clipping actuator 721. In practical hairdressing usage, a hair bundle 4 is put between the lever retainer 71 and mount retainer 72 via the open-able jaws 79; Then, the hair bundle 4 is securely held therein by mutually buckling the clipping actuator 711 and the clipping holder 721 to finish the hairdressing job for the hair bundle 4; Thereby, both middle portions of the mount retainer 72 and lever retainer 71 in the plastic hair clip 7 will outwardly bend due to suffering a tensional stress if too much hairs are held therein. However, no rupture, breakage, whiten-crazing effect at bent portion will happen in the present invention because features in malleability, re-plasticization ability and tenacity of the aforesaid polymerized plastic mixture. Moreover, the aging effect of the plastic ornamental pieces, the corrosion effect of the metal frame as well as sorting and recycling issues in the conventional hairclips can be avoided in the present invention.

I claim:

1. A plastic hairclip is made of a polymerized plastic mixture comprising 55% of 1,4-cyclohexanedimethanol (CHDM), 30% of ethylene glycol (EG), 10% of phosphotungstic acid (PTA), 1% of optical brightener and 4% of butadiene-styrene copolymer with features in avoidance that rupture, breakage or whiten-crazing effect at bent portion happens therein.

2. The plastic hairclip is recited and claimed in claim 1, wherein each said component of CHDM, EG, PTA, optical brightener and butadiene-styrene copolymer of the polymerized plastic mixture has 5% tolerance in proportional to each individual percentage respectively.

3. The plastic hairclip is recited and claimed in claim 1, wherein said butadiene-styrene copolymer is replaced by a polypropylene (PP).

4. A plastic hairclip comprises a mount retainer and a lever retainer with a pair of releasing tabs such that a first proximal end of the lever retainer and a first proximal end of the mount retainer are hinged together by a pivotal shaft to form a hinged pivotal root while a second distal end of the lever retainer and a second distal end of the mount retainer form a pair of open-able jaws to be mutually buckled each other, wherein said mount retainer and lever retainer, which are made of a polymerized plastic mixture comprising 1,4-cyclohexanedimethanol (CHDM), ethylene glycol (EG), phosphotungstic acid (PTA), optical brightener and butadiene-styrene copolymer, function to accommodate a hair bundle of group hairs between the hinged pivotal root and the pair open-able jaws.

5. The plastic hairclip is recited and claimed in claim 4, wherein each said component of CHDM, EG, PTA, optical brightener and butadiene-styrene copolymer of the polymerized plastic mixture has individual percentage as below: 55% of 1,4-cyclohexanedimethanol (CHDM), 30% of ethylene glycol (EG), 10% of phosphotungstic acid (PTA), 1% of optical brightener and 4% of butadiene-styrene copolymer.

6. The plastic hairclip is recited and claimed in claim 5, wherein each said component of CHDM, EG, PTA, optical brightener and butadiene-styrene copolymer of the polymerized plastic mixture has 5% tolerance in proportional to each individual percentage respectively.

7. The plastic hairclip is recited and claimed in claim 4, wherein said butadiene-styrene copolymer is replaced by a polypropylene (PP).

8. The plastic hairclip is recited and claimed in claim 4, wherein said pair open-able jaws comprises a clipping actuator configured at the second distal end of the lever retainer and a clipping holder configured at the second distal end of the mount retainer to be mutually buckled each other; Thereby, no rupture, breakage, whiten-crazing effect at bent portion will happen in the entire plastic hair clip including the mount retainer, lever retainer, clipping actuator and clipping holder during practical usage because features in malleability, re-plasticization ability and tenacity for the polymerized plastic mixture of CHDM, EG, PTA, optical brightener and butadiene-styrene copolymer.

9. The plastic hairclip is recited and claimed in claim 4, wherein said hinged pivotal root configured by both first proximal ends of the lever retainer and mount retainer is replaced by a jointed root, which is unitarily extruded into an integral entity with the plastic hairclip; Thereby, no rupture, breakage, whiten-crazing effect at bent portion will happen in the entire plastic hair clip including the mount retainer, lever retainer and jointed root during practical usage because features in malleability, re-plasticization ability and tenacity for the polymerized plastic mixture of CHDM, EG, PTA, optical brightener and butadiene-styrene copolymer.

* * * * *